United States Patent [19]

Bavaveas

[11] Patent Number: 4,950,083

[45] Date of Patent: Aug. 21, 1990

[54] PACKAGING FOR A LIQUID COMPOSITION WHICH IS READY FOR USE, PRODUCED FROM A CONCENTRATED LIQUID COMPOSITION, AND METHOD FOR ITS IMPLEMENTATION

[75] Inventor: Tristan Bavaveas, Paris, France

[73] Assignee: Eparco, Paris, France

[21] Appl. No.: 387,752

[22] Filed: Aug. 2, 1989

[30] Foreign Application Priority Data

Aug. 3, 1988 [FR] France ..... 88 10503

[51] Int. Cl.[5] ..... B01F 13/00; B65D 1/02; B65D 69/00; B65D 81/32

[52] U.S. Cl. ..... 366/348; 366/130; 366/162; 206/219; 206/514; 215/6; 215/10; 215/100 R; 215/DIG. 8; 220/23.4; 220/23.86

[58] Field of Search ..... 215/10, 100 R, DIG. 8, 215/228, 6; 220/23.4, 20, 23.86; 206/219, 514, 568; 222/538; 366/129, 130, 162, 348

[56] References Cited

U.S. PATENT DOCUMENTS

| | | | |
|---|---|---|---|
| 820,576 | 5/1906 | Hutchins | 215/DIG. 8 X |
| 1,918,308 | 7/1933 | Webber | 215/6 |
| 2,017,800 | 10/1935 | Hilgenberg | 206/568 X |
| 2,493,922 | 1/1950 | Miller | 215/6 |
| 2,629,508 | 2/1953 | Prager | 215/DIG. 8 X |
| 2,889,954 | 6/1959 | Tozier | 220/23.4 |
| 3,033,420 | 5/1962 | Thomas et al. | 220/20 X |
| 3,225,951 | 12/1965 | Poston et al. | 220/23.4 X |
| 3,347,403 | 10/1967 | Lehrman | 206/568 X |
| 3,590,989 | 7/1971 | Wittwer | 206/568 |
| 3,658,204 | 4/1972 | Bottger | 220/23.4 |
| 3,948,105 | 4/1976 | Johnson, Jr. | 206/219 X |
| 3,968,820 | 7/1976 | Kolb et al. | 215/DIG. 8 X |
| 4,235,343 | 11/1980 | Thompson | 215/6 |
| 4,271,965 | 6/1981 | Brambley et al. | 220/23.4 X |
| 4,292,864 | 10/1981 | Barnett | 206/219 X |
| 4,563,186 | 1/1986 | Flynn et al. | 206/219 X |
| 4,708,253 | 11/1987 | Mednis | 220/23.4 X |

FOREIGN PATENT DOCUMENTS

| | | |
|---|---|---|
| 310653 | 10/1973 | Austria . |
| 2226332 | 11/1974 | France . |
| 2572056 | 4/1986 | France . |
| 2598393 | 11/1987 | France . |

*Primary Examiner*—Sue A. Weaver

*Attorney, Agent, or Firm*—Hill, Van Santen, Steadman & Simpson

[57] ABSTRACT

The packaging for the liquid composition which is ready for use, produced by some suitable dilution and mixing in a support product such as water of a concentrated liquid composition, comprises a bottle (1) having an overall rigidity which gives it a self-supporting property, the bottle having a hollow body (2) of known volume, having an opening (3) and a removable cap (4), the bottle (1) being intended to finally receive the composition which is ready for use and to permit the preparation of the latter; a container (6) of smaller size than the bottle (1), having an overall rigidity which gives it a self-supporting property, the container having a hollow body (8) for receiving the concentrated liquid composition, in the extension of the body (2), having an opening (9), an integral measuring device (11) fixed rigidly in the opening (9), a removable cap (10) closing the measuring device (11); a hollow recess (17) in the body (2) in which the container (6) may be accommodated, this recess (17) having an opening for the removal or incorporation of the container (6); a rigid arrangement for removably holding the container (6) on the outside and against the body (2) in the recess (17); the bottle (1) being intended to receive the composition which is ready for use prepared from at least one measure of concentrated composition originating from the container (6) and from a suitable complement of the support product poured into the bottle (1).

10 Claims, 1 Drawing Sheet

PACKAGING FOR A LIQUID COMPOSITION WHICH IS READY FOR USE, PRODUCED FROM A CONCENTRATED LIQUID COMPOSITION, AND METHOD FOR ITS IMPLEMENTATION

FIELD OF THE INVENTION

The invention relates to a packaging for a liquid composition which is ready for use produced from a concentrated liquid composition, and method for its implementation.

PRIOR ART

Packagings are already known which are intended to receive a concentrated composition which, in order to be rendered ready for use, must be diluted in a certain quantity of a support product such as water. This technique is used, for example, in the field of liquid maintenance products. It has the advantage that the package produced (that is to say the concentrated composition and its packaging) is of a smaller size and smaller weight than if the composition were packaged directly ready for use. This gain in volume and in weight is advantageous, in particular, for transportation, storage and the like. This technique is implemented by packaging the concentrated composition in a flexible packaging known under the name of "sachet" or, alternatively, in a small bottle with a volume adapted to the more restricted volume of the concentrated composition. The volume of concentrated composition contained in this small bottle or this sachet generally makes it possible to produce a volume of composition which is ready for use which is much larger such that the composition which is ready for use is prepared stage by stage by using each time a certain measure of concentrated composition. In other cases, the entire volume of concentrated composition is used to form a suitable quantity of composition which is ready for use, this quantity then being much greater.

This known technique has a certain number of practical disadvantages for the user: the user must prepare the composition which is ready for use in a container and, since this container is not supplied to him, he is often lead to use containers which originally had another purpose, such as bottles for liquid foodstuff. This is naturally very dangerous, above all if the composition which is ready for use is harmful or toxic. Such containers which are not originally intended for this other use may, moreover, have a closure which is not perfectly leakproof with, equally, the resulting disadvantages. Moreover, the user must mix the appropriate volumes of concentrated composition and support product and measuring is not easy. If such a measuring member is provided, it is for the concentrated composition alone but not the support product. The volume of the container used for the composition which is ready for use is not generally exactly adapted to the volume of composition which is ready for use, which must be produced. The user also, finally, is left with two containers, one for the composition which is ready for use and the other for the concentrated composition, these two containers being different and separate, with the resulting risks of loss, and the like. Finally, in the particular case in which the concentrated composition is in a sachet, pouring out of the concentrated composition may sometimes give rise to problems and storage of such an open sachet is virtually impossible. Finally, if, in order to avoid problems, the user prepares all the composition at once by using the entire concentrated composition, he finds he has prepared a large quantity of composition which is ready for use with the resulting problems of storage.

Containers are also known from documents AT No. 310,653, U.S. Pat. No. 4,271,965, FR No. 2,598,393, FR No. 2,226,332 and U.S. Pat. No. 4,235,343, but they do not make it possible to solve the problem of the production of a liquid composition which is ready for use from a concentrated composition.

SUMMARY OF THE INVENTION

The invention therefore aims to solve the problem of the packaging of a composition which is ready for use based on a concentrated composition in a support product.

To this end, the invention relates to a packaging for a liquid composition which is ready for use produced by some suitable dilution and mixing in a support product such as water of a concentrated liquid composition, more particularly a maintenance product, which comprises a bottle having an overall rigidity which gives it a self-supporting quality, the bottle comprising a hollow body of known volume having an opening, an extension and a removable cap, the bottle being intended to finally receive the composition which is ready for use and to permit the preparation of the latter; a container of a smaller size than the bottle having an overall rigidity which gives it a self-supporting quality comprising a hollow body for receiving the concentrated liquid composition, located the container being in the extension of the body, having an opening, an integral measuring device fixed rigidly in the opening, a removable cap closing the measuring device; a hollow recess in the body in which the container may be accommodated, this recess having an opening for the removal or incorporation of the container; rigid and removable means for holding the container on the outside and against the body in the recess; the bottle being intended to receive the composition which is ready for use prepared from at least one measure of concentrated composition originating from the container and from a suitable complement of the support product poured into the bottle.

The invention as described and claimed therefore makes it possible to obtain in combination the following advantages and effects: the user has available a container for the preparation of the composition which is ready for use, namely, the actual bottle. This bottle is of a suitable volume, which is specially determined as a function of the measure of concentrated composition used as dispensed by the integral measuring device in the container. The preparation of the composition which is ready for use is therefore facilitated. There is no risk of error in respect of the contents of the bottle. Since the bottle and the container are joined together, they together form a single-piece assembly which facilitates storage, is cleaner and more attractive. There is no risk of losing one of the containers, bottle or container, both normally remaining associated with one another. The closures may be specially adapted to the packaged composition, in particular as regards to safety devices. The bottle may receive appropriate marking which dispenses with the need for the user himself to carry out the marking.

BRIEF DESCRIPTION OF THE DRAWINGS

The other characteristics will result from the description which follows, with reference to the appended drawings in which.

DESCRIPTION OF THE PREFERRED EMBODIMENTS

Figure 1:
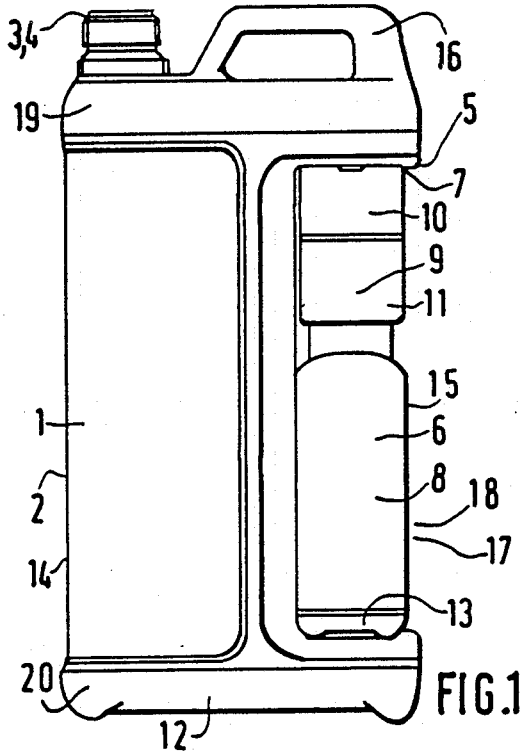
FIG. 1 is a diagrammatic view from the side and in elevation of a packaging according to the invention, the container being associated with the bottle.

The invention relates to a packaging (contents and container) for a liquid composition which is ready for use produced by suitable dilution and mixing of a concentrated liquid composition and a support product such as water. The packaging comprises a bottle 1 of the type having an overall rigidity which gives it a self-supporting quality, which comprises a hollow body 2 for receiving contents of a known volume; an opening 3 for discharge of the contents, located on the hollow body 2; and a removable closure 4 of the discharge opening 3, such as a cap.

This bottle 1 comprises, moreover, integral members 5 for holding another container 6, provided with complementary members 7 for this holding, the holding members 5, 7 together forming rigid means for holding the container 6 on the bottle 1 in a removable manner, that is to say that the container 6 may be removed from or re-placed on the bottle 1 at the sole discretion of the user.

The bottle 1 therefore supports in a removable manner, via the holding means 5, 7, the container 6 which also has an overall rigidity which gives it a self-supporting quality, also comprising a hollow body 8 for receiving contents; an opening 9 for discharge of the contents located on the hollow body 8; and therefore having a removable closure 10 for the discharge opening 9, such as a cap. The container 6 comprises, moreover, an integral measuring device 11 represented in the figures only by its outer jacket, located in the opening 9 and forming an integral part of the container 6 and closed by means of the removable closure 10.

The concentrated composition is placed in the container 6. The bottle 1 is intended to receive a suitable quantity of concentrated composition (a measure) and a suitable complement of support product until a certain quantity of composition which is ready for use is formed.

The bottle 1 is generally more bulky than the container 6 and serves as a support for the container 6. For example, the hollow body 2 of the bottle 1 may have an internal volume of the order of 2 to 3 times the internal volume of the hollow body 8 of the container 6.

The bottle 1 comprises the hollow body 2, the opening 3 and the closure 4, and the container 6 comprises the hollow body 8, the opening 9 and the closure 10 may, as regards their general structure, each be of any type which is known per se or which is within the scope of a person skilled in the art. For example, the bottle 1 and the container 6 may be produced in a plastic material which has a certain overall rigidity in order to have a certain behaviour. If appropriate, the walls of the hollow bodies 2, 8 may have a certain resilient flexibility. Or, conversely, the walls of the hollow bodies 2, 8 may be rather rigid and provided, to this end, with rigidification ribs. The hollow bodies 2, 8 are generally of the type comprising a normally horizontal lower base 12, 13 respectively, and lateral walls of general vertical direction 14, 15 respectively. The openings 3, 9 are preferably located at the top of the hollow bodies 2, 8 respectively. The closures 4, 10 are, for example, stoppers such as screw stoppers, pressure-engagement stoppers, capsules and the like.

The bottle 1 also preferably comprises a handle 16 or equivalent permitting handling of the bottle 1 alone or with its container 6. The container 6 itself may dispense with such a handle, given its small size and the fact that it therefore can be simply held in the user's hand. In an alternative embodiment, the container 6 may also comprise a handle or equivalent.

The container 6 is placed on the outside and against or close to the bottle 1, in particular against its lateral wall 14 in a hollow recess 17 provided in the body 2 on the outside. Moreover, the body 8 of the container 6 is preferably at least substantially in the extension of the body 2 of the bottle 1, the bottle 1/container 6 assembly forming a compact assembly whose overall outer form is precisely reminiscent of that of a container of the bottle type. Consequently, the recess 17 is designed to correspond substantially to the form of the container 6. This is conveniently made possible because the container 6 is smaller than the bottle 1.

The holding means 5, 7 are an integral part of the bottle 1 and of the container 6 in particular and hollow bodies 2, 8. These holding means comprise, for example, projections 5 in the body 2 of the bottle 1, in particular at the site of or close to the opening 18 for incorporation of the container 6 in the recess 17 or for removal of the container 6 from the recess 17, these projections 5 interacting with the actual container 6, in particular its base 13, its lateral walls 15, its closure 10 or interacting with contoured, hollow projections of the container 6.

The measuring device 11 of the container 6 is fixed rigidly in its discharge opening 9. Such measuring devices are not per se the subject of the present invention. They may, for example, be of the type described in the document FR No. 2,572,056, without this embodiment being limiting.

The method according to the invention is as follows: initially, the concentrated composition is located in the container 6 and the bottle 1 is empty or is supplied filled with composition which is ready for use. When the user wishes to prepare the composition which is ready for use, because the bottle 1 is empty, he first removes the container 6 from the bottle 1. This operation is performed by a simple manual traction operation by virtue of the elasticity of the projections 5. The bottle 1 and the container 6 are opened, the respective closures 4 and 10 being removed. The user may then make up a measure of concentrated composition by virtue of the measuring device 11. According to the nature of the measuring device 11, this measure is produced by placing the container 6, either with its opening 9 upwards or, on the other hand, with its opening 9 downwards. As the appropriate measure of concentrated composition thus defined is produced, it may be introduced into the bottle 1 via the opening 3. In addition, the user may continue suitable filling of the hollow body 2 simply by pouring in the support product such as water via the opening 3 until the bottle 1 is filled in a suitable manner.

The container 6 may be closed again by putting back the closure 10 over the opening 9. The bottle 1 may also be closed again by putting back the closure 4 on the opening 3. If appropriate, the bottle 1 is shaken in order to obtain as homogeneous a mixture of the concentrated composition and the support product as possible. Finally, the composition which is ready for use located in the hollow body 2 may be used. The container 6 may be associated once more with the bottle 1.

Naturally, certain stages of the method may take place in a different order, which does not fundamentally change the method of implementation of the invention. Moreover, a certain number of alternative embodiments may be envisaged. Thus, the quantity of concentrated composition may be a single measure obtained by means of the measuring device 11 or any multiple of such a single measure.

Means are provided for marking the total volume of the composition which is ready for use to be produced, that is to say of the complement of support product to be introduced into the bottle 1, more precisely its body 2. These means of marking may be either the actual volume of the hollow body 2 which must be filled in order for the volume of composition which is ready for use to be suitable, or, alternatively, a line or a contour forming a limit provided in the hollow body 2 in the vicinity of the opening 3.

The opening 3 is not only an opening for discharge of the composition which is ready for use but also a filling opening for the concentrated composition and for the support product. For this reason, the opening 3 has an internal diameter which is sufficient to allow filling without the risk of spillage. Moreover, the diameter of the opening 3 and the diameter of the opening 9 are produced in a ratio to one another, the diameter of the opening 3 generally being greater than that of the opening 9.

The invention is particularly effective in the case where the measuring device 11 is of the type in which the measuring is performed with the container 6 being held substantially vertically with its opening 9 upwards, as is possible with a device of the type described in document FR No. 2,572,056. In fact, in such a case, the measure of concentrated composition is first formed in the measuring device 11, the container 6 being held with its opening 9 towards the top and then the container 6 is placed over the bottle 1, the opening 9 being perpendicular to the opening 3 so as to enable the concentrated composition located in the measuring device 11 to be poured into the hollow body 2.

Figure 2:
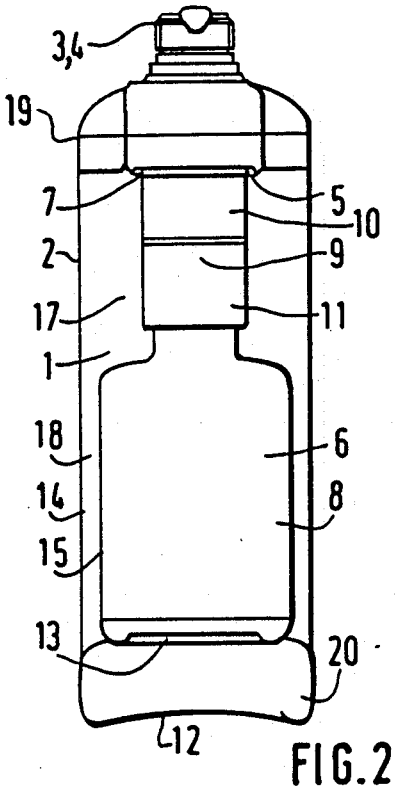
FIG. 2 is an end view of the packaging of FIG. 1, from the side on which the container is located.
Figure 4:
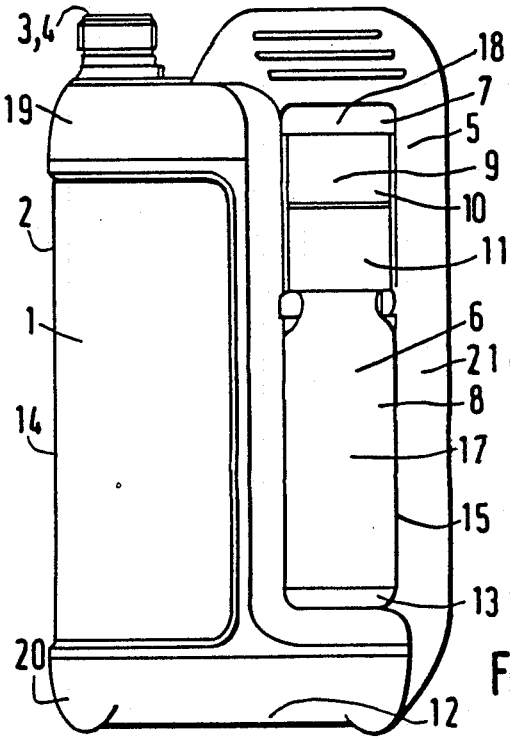
FIG. 4 is a side view in elevation of another alternative embodiment of the packaging.
Figure 3:
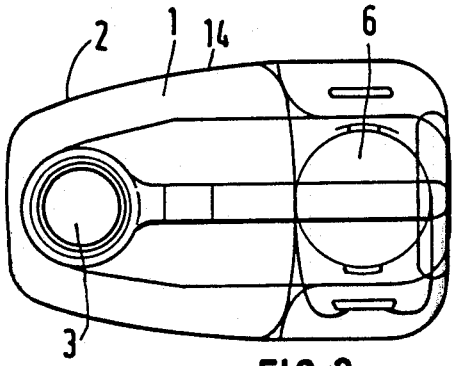
FIG. 3 is a plan top view of the packaging of FIGS. 1 and 2.

Reference will now be made more particularly to FIGS. 1 to 3 which show a bottle 1 whose general form is reminiscent of that of a can, whose handle 16 is located at the top right next to the opening 3 and its closure 4. In this case, the bottle 1 comprises two rigidification bands, an upper band 19 and a lower band 20, respectively. The band 19 is located just below the opening 3 and the handle 16 and forms the upper part of the lateral wall 14. The lower band 20 forms the base 12 and the extreme lower part of the lateral wall 14. These bands 19, 20 extend not only over the body 2 but also laterally in order to form the recess 17 which, in this case, is open at 18 on three sides and closed on its fourth side by the lateral wall 14. The projections 5 are then obtained via inward projections on the edge of the opening 18 as is expressly shown in the figures. FIG. 4 shows another alternative embodiment in which the bottle 6 has no handle, the corresponding zone being, for example, more or less solid. Moreover, the recess 17 is open at 18 only on two sides, the front and back respectively, and is closed on two other sides, on the one hand by the lateral wall 14 and, on the other hand, by an additional outer wall 21 which is substantially vertical and parallel to the lateral wall 14 at the location of the recess 17. In this alternative embodiment, the holding means consist of the recess 17, access to which is possible via the two front or rear openings 18, this housing thus being limited by the lateral walls, 14, 21 and the bands 19, 20. In this case, provision may also be made for projections of a resilient type engaging, for example, on the container 6 between the closure 10 and the largest part of the body 8. Or, alternatively, at the location where the container 6 forms a neck. Or, alternatively, the container 6 may be held in the recess 17 by means of slight friction.

I claim:

1. A packaging for a liquid composition, which is ready for use and is produced by some suitable dilution and mixing of a concentrated liquid composition in a support product, said packaging comprising a bottle and a container, said bottle having first wall means for providing an overall rigidity and a self-supporting quality, said first wall means defining a first hollow body of a known volume having a first opening and an outer recess along one side of the bottle, a bottle cap removably covering said first opening, said bottle being intended to finally receive the liquid composition which is ready to be used and to permit the preparation of the liquid composition, said container being of a smaller size than said bottle and having second wall means for providing an overall rigidity and self-supporting quality, said second wall means defining a second hollow body for receiving the concentrated liquid composition, said second hollow body having a second opening with an integral measuring device, a removable cap for closing the second opening and measuring device, said recess having a recess opening allowing said container to be releasably received in said outer recess, said recess having rigid means for holding the container in said recess and against said one side of the bottle so that said container is stored in said recess and, when a batch of the liquid composition is to be prepared, the container is removed, the measuring device is filled and then emptied into the bottle, which is filled with the support product.

2. A packaging according to claim 1, wherein the first wall means also forms a handle for the bottle.

3. A packaging according to claim 1, wherein the rigid means provides projections on said recess adjacent said recess opening for interacting with the container when it is inserted into the recess.

4. A packaging according to claim 1, wherein said first wall means forms the recess with a band portion spaced from said one side, said rigid means providing a projection on one of said one side and said band portion for engaging said container.

5. A packaging according to claim 4, wherein said rigid means provides a projection on both said one side and said band portion.

6. A packaging according to claim 1, wherein said first wall means forms a mark in said hollow body to define a given volume.

7. A packaging according to claim 1, wherein the first opening has a diameter which is sufficient to enable filling without the risk of spillage and which is greater than the diameter of the second opening.

8. A packaging according to claim 1, wherein said first wall means provides a pair of spaced apart extensions which extend from said one side to form the recess, said rigid means forming projections on both extensions for engaging said container.

9. A packaging according to claim 8, wherein one extension of said pair of spaced apart extensions is adjacent a bottom of said bottle and the other extension of said pair of spaced apart extensions is adjacent a top of said bottle.

10. A method for mixing and preparing a liquid composition comprising the steps of providing a packaging including a bottle having first wall means for providing an overall rigidity and self-supporting quantity, said wall means defining a first hollow body of a known volume having a first opening and an outer recess along one side of the bottle, a bottle cap removably closing said first opening, a container being of a size smaller than said bottle and having second wall means for providing an overall rigidity and self-supporting quantity, said second wall means defining a second hollow body filled with a concentrated liquid composition, said second hollow body having a second opening with an integral measuring device being closed by a removable cap, said container being disposed in said recess and said recess having rigid means for holding the container in said recess against one side of said bottle; removing the container from said recess; removing the bottle cap from said first opening and removing the removable cap from said second opening; utilizing the measuring device of said container to measure a suitable volume of the concentrated liquid composition; pouring the measured suitable volume through the first opening of said bottle; adding the support product into said bottle; applying said bottle cap to said first opening; and then shaking said bottle to mix and to finish the preparation of said liquid composition.

* * * * *